US006185159B1

(12) United States Patent
Sun et al.

(10) Patent No.: US 6,185,159 B1
(45) Date of Patent: Feb. 6, 2001

(54) RADIO CONTROL ALARM DEVICE

(75) Inventors: Stan Sun; Alan Yi, both of Taichung (TW)

(73) Assignee: Mosel Vitelic Inc. (TW)

( * ) Notice: Under 35 U.S.C. 154(b), the term of this patent shall be extended for 0 days.

(21) Appl. No.: 09/368,628

(22) Filed: Aug. 5, 1999

(30) Foreign Application Priority Data

May 25, 1999 (TW) ..... 88108534

(51) Int. Cl.[7] ..... G04C 11/02; G04C 21/00; G04B 23/02

(52) U.S. Cl. ..... 368/47; 368/73

(58) Field of Search ..... 368/47, 72–74, 368/250, 251

(56) References Cited

U.S. PATENT DOCUMENTS 5,537,101 * 7/1996 Nakajima et al. ..... 340/825.21
5,805,530 * 9/1998 Yeungberg ..... 368/47
5,898,643 * 4/1999 Yasuoka et al. ..... 368/47
5,991,240 * 11/1999 Van Ryzin ..... 368/47

* cited by examiner

*Primary Examiner*—Vit Miska
(74) *Attorney, Agent, or Firm*—Morrison & Foerster LLP

(57) ABSTRACT

An alarm device for ringing an alarm at a variable time comprises a receiver, a processor and a speaker. The receiver receives a radio frequency signal carrying a standard time and an alarm time correction and transfers the standard time and the alarm time correction to the processor after decoding the radio frequency signal. The processor is coupled to the receiving circuit for input of the standard time and the alarm time correction. The processor keeps the current time by and stores an alarm time reference. With the input of the standard time and the alarm time correction, the processor calibrates the current time with the standard time, corrects the reference to obtain an alarm time according to the correction, and outputs a driving signal at arrival of the alarm time. The speaker is coupled to the processor and driven to sound by the driving signal.

17 Claims, 3 Drawing Sheets

RADIO CONTROL ALARM DEVICE

FIELD OF THE INVENTION

The present invention is related to a radio control clock, and more particularly to a radio control alarm clock that automatically performs the correction of the current time and the alarm time.

BACKGROUND

At present, in many countries such as German, Japan, England and the United States, a permanent standard time signal is provided by transmitting a radio frequency signal carrying standard time codes by 60-bit time frames. People in those countries can calibrate their apparatus or equipment relevant to time or frequency using the standard time signal. A radio control clock that receives this standard time signal and can read the standard time codes is also provided. The difference between the radio control clock and a conventional clock is that the former can always provide a standard time by automatic time calibration using the standard time signal.

For example, a time frame 10 of a standard time signal provided in Mainflingen, Germany is shown in FIG. 1. The bits of the time frame 10 are transmitted at a rate of 1 bit per minute. In other words, the time frame 10 is transmitted in one minute, which is why we call it Time Frame 1 Minute. The standard time signal carries many time frames in sequence. The standard time code is located from the $15^{th}$ to the $59^{th}$ bit, which includes the information of the minute, the hour, the day of the week, the month and the year of the standard time. It should be noted that the $0^{th}$ to $14^{th}$ bit are unused.

Additionally, FIG. 2 is a typical block diagram of a conventional radio control clock 20. The radio control clock 20 includes a signal receive circuit 21, a microprocessor 23, an input device 25 and a display 27. The signal receive circuit 21 may be a satellite, radio frequency or telephone signal depending on the type of the standard time signal. For example, a Time Code Receiver T4225B receives signals at frequencies from 40 to 80 kHz. The microprocessor 23 has a timer (not shown) to keep a current time which is displayed by the display 27. The operation of the radio control clock is described below. First, the signal receive circuit 21 receives a radio frequency signal carrying the standard time and decodes it. Then, the signal receive circuit 21 transfers to the microprocessor 23 a binary code BC representing the standard time derived from the radio frequency signal. The microprocessor 23 performs computations with the binary code BC to correct the current time. The microprocessor 23 can also send a control signal CS to the signal receive circuit 21 so that the signal receive circuit 21 is turned on in response to the control signal CS when time correction is requested. Otherwise, the signal receive circuit 21 is turned off. The input device 25 performs the input of data as needed. For example, before performing the time correction, the microprocessor 23 turns on the signal receive circuit 21 in response to the instructions of the user through the input device 25.

Although the radio control clock can provide the standard time by receiving a standard time signal, it is insufficient in some specific applications. For example, Moslems have five different times of worships a day. Since these times vary with days and seasons, it is difficult for them to have precisely the same five worship times around the world, even though they can have the same current time by using the radio control clock described above. Consequently, in this case, some improvements of the conventional radio control clock are needed.

SUMMARY OF THE INVENTION

Therefore, the present invention provides an alarm device for ringing an alarm at a variable time is provided according to the invention. The device comprises a receiver, a processor and a speaker. The receiver receives a radio frequency signal carrying a standard time and an alarm time correction and transfers the standard time and the alarm time correction after decoding the radio frequency signal. The processor is coupled to the receiving circuit for input of the standard time and the alarm time correction. The processor keeps a current time and stores an alarm time reference. With the input of the standard time and the alarm time correction, the processor calibrates the current time with the standard time, corrects the reference to obtain an alarm time according to the correction, and outputs a driving signal at arrival of the alarm time. The speaker is coupled to the processor and driven to sound by the driving signal.

Furthermore, the present invention provides a method of ringing an alarm at a variable time is also provided. The method comprises the step of providing a radio frequency signal carrying a standard time and an alarm time correction, receiving the radio frequency signal with an alarm device which has an alarm time reference and keeps a current time, calibrating the current time with the standard time, correcting the alarm time reference to obtain an alarm time according to the alarm time correction, and ringing an alarm with the alarm device at the alarm time.

Here, if the alarm time reference refers to the mean worship times over a whole year and the alarm time correction refers to the difference between the mean and the worship time on that day, the alarm time will be the worship time accordingly. That is to say, the invention will solve the problem mentioned above. Therefore, arrival of the worship time can be signaled with the radio control alarm clock so that it is possible for Moslems around the world to have precisely the same worship time.

DETAILED DESCRIPTION

Figure 3:
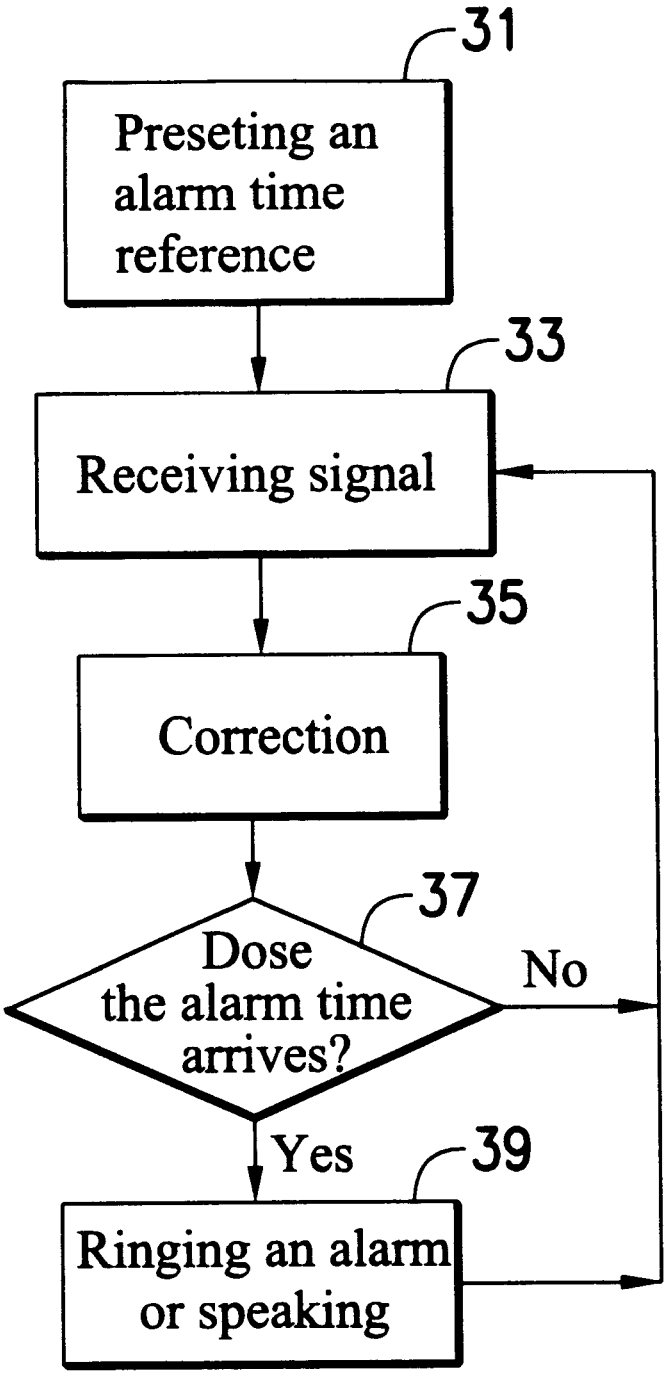
FIG. 3 is a flow chart of the method of ringing an alarm according to one embodiment of the invention.

Please refer to FIG. 3. A flow chart of the method of ringing an alarm according to one embodiment of the invention is shown.

First, according to the step 31, preset an alarm time reference of a radio control alarm clock through an input device.

According to the step 33, the radio control alarm clock receives a radio frequency signal carrying the information of the standard time and an alarm time correction.

According to the step 35, the radio control alarm clock performs the correction of the current time and the alarm time reference according to the standard time and the alarm time correction, respectively. An alarm time is obtained thereby.

According to the step 37, proceed to the next step when the alarm time arrives, otherwise the radio control alarm clock keeps waiting for arrival of the alarm time or receives the standard time signal carrying new information when requested.

Finally, according to the step 39, the radio control alarm clock rings an alarm or speaks, and receives the standard time signal carrying new information when requested.

Figure 1:
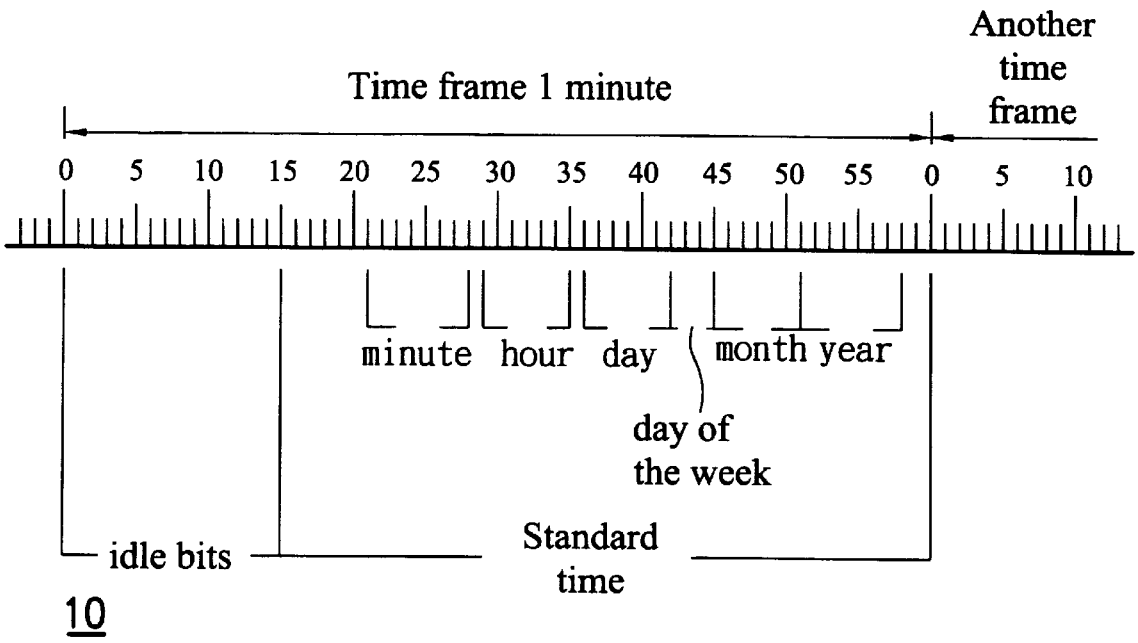
FIG. 1 illustrates the arrangement of the bits in a time frame 10 of a standard time signal.
Figure 4:
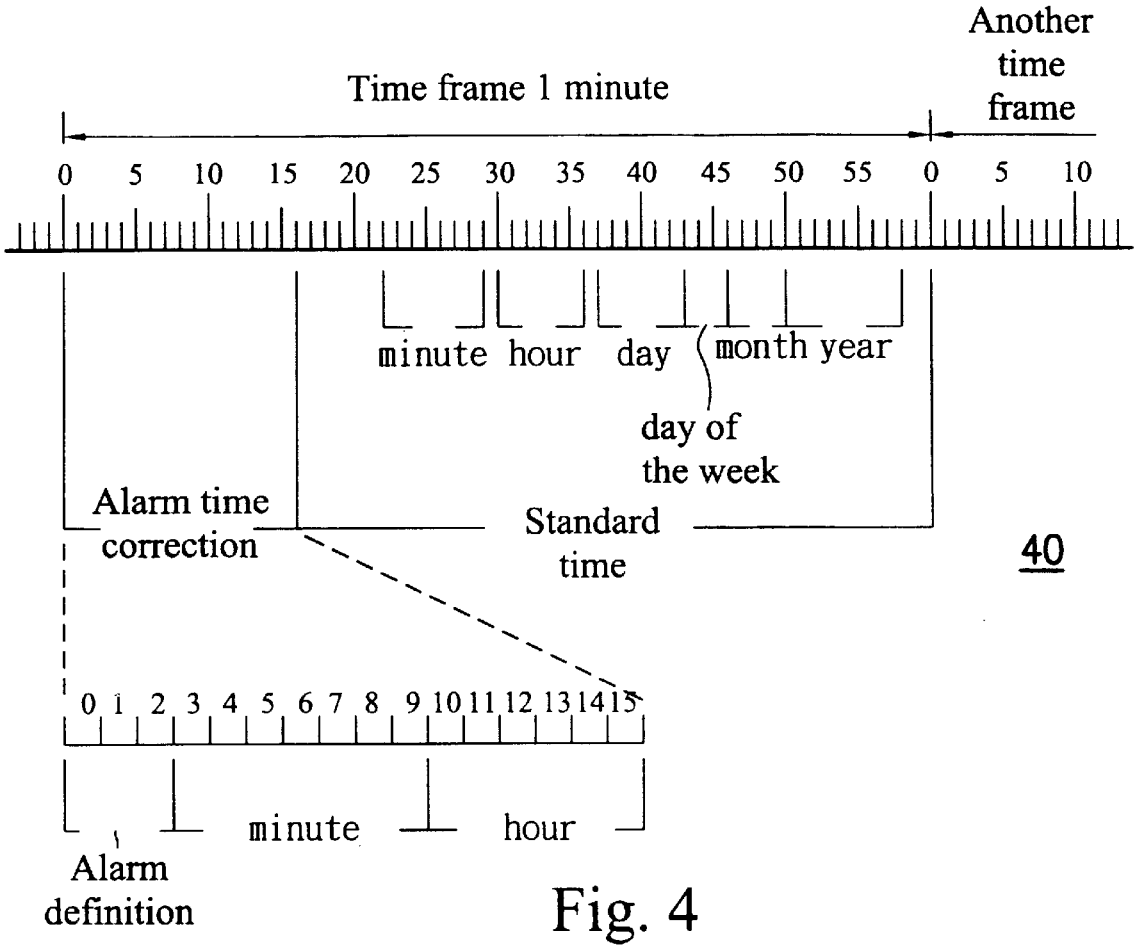
FIG. 4 illustrates the arrangement of the bits in a time frame 40 of a standard time signal according to one embodiment of the invention.

Additionally, the arrangement of the bits within a time frame 40 of a standard time signal according to this embodiment is shown in FIG. 4. With comparison to the arrangement shown in FIG. 1, it can be seen that the number of the bits used for representing the month of the standard time is reduced from 5 to 4 and the originally unused bits accompanied with the saved bit are now used for an alarm time correction. Therefore, in this arrangement, the standard time is coded with the $16^{th}$ to $59^{th}$ bit and the alarm time correction with the $0^{th}$ to $15^{th}$ bit.

The following descriptions illustrate the arrangement of the $0^{th}$ to $15^{th}$ bit. The $0^{th}$ to $2^{nd}$ bit are used for an alarm definition. For example, the first to the fifth worship time may be represented by 000, 001, 010, 011 and 100 while 101, 110 and 111 may represent other religious activities. The $3^{rd}$ to $9^{th}$ bit are used for the minute of the alarm time correction and the $10^{th}$ to $15^{th}$ bit for the hour of the correction.

More specifically, in the case of Moslem's worship time, the mean of the first worship times within a whole year is 6:00. Therefore, the alarm time reference of the first worship time is 6:00. One day the accurate first worship time is 35 minutes earlier than the mean and the alarm time correction equals to −35 minutes accordingly. A 16-bit binary code, 100000 0110101 000 is derived. The 3 least significant bits, 000, represent the first worship, the 7 subsequent bits, 0110101, represent the minute, 35 in this example, and the 6 most significant bits, 100000, represent the hour, 0 in this example. It is also noted that the first most significant bit of the hour is 1, which means that the correction is minus. That is to say, the alarm time will be derived by subtracting the correction from the alarm time reference. By receiving the radio frequency signal, the radio control alarm clock corrects the alarm time reference to 5:25 and rings an alarm at that time.

In the above example, the alarm time correction varies with days and is carried by the radio frequency signal after being predetermined by computations. Because that the $0^{th}$ to $2^{nd}$ bit may be used for up to 8 alarm definitions, the other four worship times on that day can be obtained if the other four alarm time references of worship times (i.e. the other four means of the other four worship times) are also stored in the radio control alarm clock.

Figure 2:
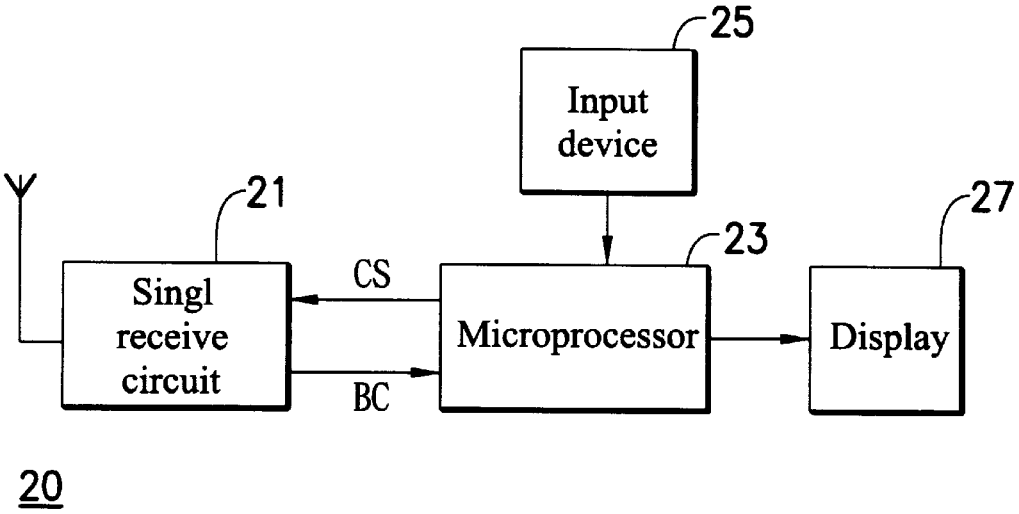
FIG. 2 is a block diagram of a conventional radio control clock 20.
Figure 5:
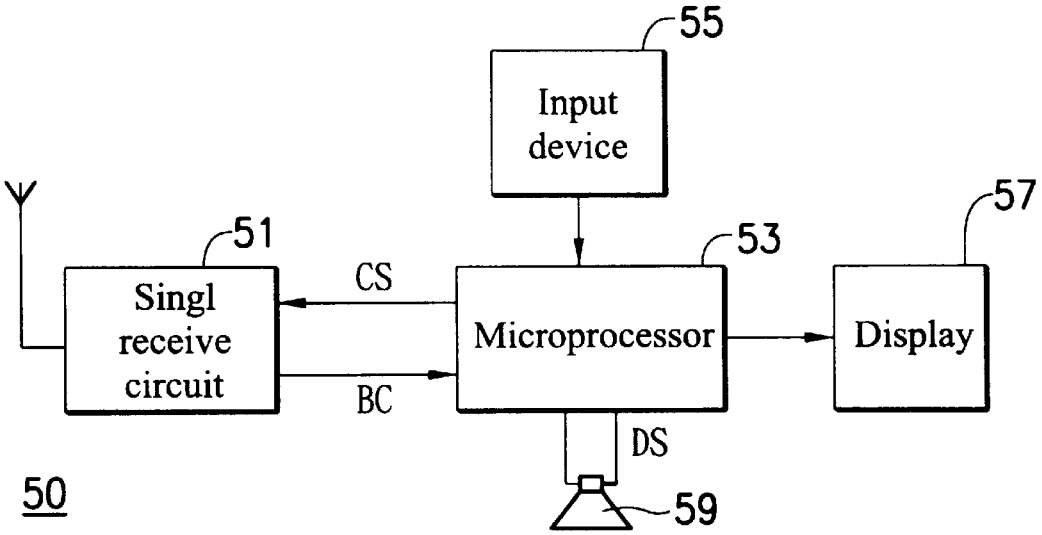
FIG. 5 is a block diagram of a radio control alarm clock 50 according to one embodiment of the invention.

Please refer to FIG. 5. The radio control alarm clock 50 includes a signal receive circuit 51, a microprocessor 53, an input device 55, a display 57 and a speaker 59. The signal receive circuit 51, the input device 55 and the display 57 are the same as those of the radio control clock 20 in FIG. 2. In addition to all the functions of the microprocessor 23 of the radio control clock 20 in FIG. 2, the microprocessor 53 further performs the storage and correction of the alarm time reference and the driving of the speaker 59 to ring an alarm. The microprocessor 53 may be implemented by 20"/60"/90"/120" Voice Smart MSU001/MSU3022/MSU3032/MSU3042 manufactured by MOSEL VITELIC INC. The operation of the radio control clock is described below. First, an alarm time reference is inputted and stored in the microprocessor 53 through the input device 55. The signal receive circuit 51 receives the radio frequency signal carrying the standard time and the alarm time correction, and decodes it. Then, the signal receive circuit 51 transfers to the microprocessor 53 a binary code BC representing the standard time and the alarm time correction derived from the radio frequency signal. The microprocessor 53 performs computations with the binary code BC to correct the current time and the pre-stored alarm time reference. Thus, an alarm time is obtained. When the alarm time arrives, a driving signal DS from the microprocessor 53 drives the speaker to sound or speak. The microprocessor 53 can also send a control signal CS to the signal receive circuit 51 so that the signal receive circuit 51 is turned on in response to the control signal CS when time correction is requested. Otherwise, the signal receive circuit 51 is turned off.

The embodiment described above is illustrative of the principles of the present invention and are not intended to limit the invention to the particular embodiment described. Those skilled in the art may make various changes in the embodiments without departing from the spirit and scope of the invention. Various embodiments are within the scope of the following claims.

What is claimed is:

1. A method of ringing an alarm at a variable time, comprising the step of:

providing a radio frequency signal carrying a standard time and an alarm time correction;

receiving the radio frequency signal with an alarm device which has an alarm time reference and keeps current time;

calibrating the current time with the standard time and correcting the alarm time reference to obtain an alarm time according to the alarm time correction; and ringing an alarm with the alarm device at the alarm time.

2. The method of ringing an alarm at a variable time in claim 1, wherein the alarm time correction is the difference between the alarm time reference and the alarm time.

3. The method of ringing an alarm at a variable time in claim 2, wherein the alarm time reference is a mean of predetermined times, and the alarm time is one of the predetermined times.

4. The method of ringing an alarm at a variable time in claim 3, wherein a 16-bit binary code is used to represent the alarm time correction.

5. The method of ringing an alarm at a variable time in claim 4, wherein the 16-bit binary code has 6 bits which are used for the hour of the alarm time correction, and seven are used for the minute.

6. The method of ringing an alarm at a variable time in claim 4, wherein the 16-bit binary code further represents an alarm definition.

7. The method of ringing an alarm at a variable time in claim 6, wherein the 16-bit binary code has 3 bits which are used for the alarm definition.

8. An alarm device for ringing an alarm at a variable time, comprising:

a receiver for receiving a radio frequency signal carrying a standard time and an alarm time correction, and transferring the standard time and the alarm time correction after decoding the radio frequency signal;

a processor which keeps a current time and stores an alarm time reference and is coupled to the receiving circuit for input of the standard time and the alarm time correction, wherein said processor calibrates the current time with the standard time, corrects the alarm time reference to obtain an alarm time according to the alarm time correction, and outputs a driving signal at arrival of the alarm time; and a speaker coupled to the processor and being driven to sound by the driving signal.

9. The alarm device for ringing an alarm at a variable time in claim 8, wherein the alarm time correction is the difference between the alarm time reference and the alarm time.

10. The alarm device for ringing an alarm at a variable time in claim 9, wherein the alarm time reference is a mean of predetermined times, and the alarm time is one of the predetermined times.

11. The alarm device for ringing an alarm at a variable time in claim 10, wherein a 16-bit binary code is used to represent the alarm time correction.

12. The alarm device for ringing an alarm at a variable time in claim 11, wherein the 16-bit binary code has 6 bits which are used for the hour of the alarm time correction, and seven are used for the minute.

13. The alarm device for ringing an alarm at a variable time in claim 11, wherein the 16-bit binary code further represents an alarm definition.

14. The alarm device for ringing an alarm at a variable time in claim 13, wherein the 16-bit binary code has 6 bits which are used for the alarm definition.

15. The alarm device for ringing an alarm at a variable time in claim 8 further comprising an input device coupled to the processor by which the alarm time reference is inputted into the processor.

16. The alarm device for ringing an alarm at a variable time in claim 8 further comprising a display coupled to the processor displaying the current time.

17. The alarm device for ringing an alarm at a variable time in claim 8, wherein the processor turns the receiver on or off by transmitting a control signal to the receiver.

* * * * *